United States Patent [19]

Polke

[11] 4,064,685

[45] Dec. 27, 1977

[54] PREFORMING APPARATUS FOR WIRES IN STRANDING MACHINES

[75] Inventor: Hans-Joachim Polke, Werdorf, Germany

[73] Assignee: W. H. Kuester K.G., Germany

[21] Appl. No.: 725,458

[22] Filed: Sept. 22, 1976

[30] Foreign Application Priority Data

Apr. 28, 1976 Germany ..... 2618586

[51] Int. Cl.[2] ..... D07B 3/00; D07B 7/00

[52] U.S. Cl. ..... 57/55; 57/9

[58] Field of Search ..... 57/1 R, 9, 55, 138, 57/156

[56] References Cited

U.S. PATENT DOCUMENTS

| | | | |
|---|---|---|---|
| 1,945,799 | 2/1934 | Blamire | 57/9 |
| 1,998,430 | 4/1935 | Barclay | 57/9 |
| 2,036,393 | 4/1936 | Briggs | 57/9 X |
| 2,757,505 | 8/1956 | Vennett | 57/55 X |
| 3,811,257 | 5/1974 | Burr | 57/55 X |

*Primary Examiner*—Donald Watkins
*Attorney, Agent, or Firm*—Gilbert L. Wells

[57] ABSTRACT

A preforming apparatus for stranding machines for imparting to the wires or strands the helical wave shape the wires have to assume in the finished rope. For each wire or strand to be wound into the rope one particular preforming device is provided on a common base plate. Each preforming device comprises rollers around which the wires are guided. At least one roller in each preforming device is adjustable in its position relative to the other rollers of the device in order to vary the wave shape of the wires; and setting means are provided on the base plate for simultaneously and jointly setting all adjustable rollers in one single operating step.

13 Claims, 6 Drawing Figures

PREFORMING APPARATUS FOR WIRES IN STRANDING MACHINES

BACKGROUND OF THE INVENTION

The present invention relates to preforming apparatus for a stranding machine, in particular apparatus for the preforming of wires and strands directly ahead of the stranding point in stranding machines.

It is known that wires or strands during the production of ropes experience a twisting around the insert, which has the consequence that the wires in the finished rope are disposed under appreciable stress. When such a rope is cut through, the rope end unravels and forms a so-called brush.

Different methods are known for countering this stress, for example, preforming of the wires. In this method, the wires are deformed beyond the elastic limit into a wave shape by a suitable preforming device arranged immediately ahead of the stranding point. Since this wave-shaped deformation takes place in the running wire, the main axes of which (vertical and horizontal) are not tilted during the rotary motion of the ropes for the stranding process but are merely displaced parallel to one another, the wire is provided with a spatial wave shape, i.e. a helical shape, which corresponds to the shape the wire assumes in the finished rope, which results in an appreciable reduction of the above-mentioned stress.

The deformation of the wire is produced in the preforming apparatus by guiding the wire over two or three rollers, which are journalled overhung and which are adjustable in their spacings or lateral settings relative to each other. There are two different kinds of preforming apparatus known, in one of which the axes of the rollers in the longitudinal direction of the stranding machine are aligned with a slight inclination to the central axis and in the other one of which the axes of the rollers extend transversely to the longitudinal direction of the stranding machine and thus run perpendicularly to the central axis, but at a lateral spacing therefrom.

The present invention concerns preforming apparatus of the last-mentioned kind, in which the roller axes are perpendicular to and spaced from the axis of the machine. The known devices of this kind as a rule consist of three rollers, with the wires running through between the rollers. The actual helical shape of the wire is in that case dependent on, apart from the diameter of the rollers, how closely the rollers are to one another and how deeply the middle roller is pushed in between the other two rollers. When the helical shape of the wire is to be altered, two resetting processes are necessary: on the one hand, the spacing of the outer rollers must be reset, and, on the other hand, the depth of the middle roller must be reset.

Since wire ropes now generally consist of six, eight or even more individual or stranded wires, the stranding machines thus have six, eight or more spools and there must also be present six, eight or more preforming devices, since each wire or each strand must be individually deformed.

It is a disadvantage of the known preforming apparatus of this kind that each of the preforming devices must be individually adjusted when a new setting is necessary. While it is relatively simple and in fact known to provide a common resetting device for all the preforming devices in preforming apparatus with roller axes extending in the direction of the machine axis but somewhat inclined thereto, the possibility of common resetting has hitherto been absent in apparatus having preforming devices with roller axes extending transversely to the machine axis.

It is, therefore, the object of the present invention to provide a common resetting mechanism also in preforming devices having roller axes extending transversely to the machine axis.

SUMMARY OF THE INVENTION

According to the present invention this object is attained by a preforming apparatus comprising a base plate mountable on a stranding machine to be rotatable about the machine axis, a plurality of preforming devices arranged on the base plate and each comprising a respective pair of preforming rollers arranged on respective carrier means to be rotatable about axis substantially perpendicular to and spaced from the machine axis, the axis of rotation of at least one of the rollers of each roller pair being adjustable in position relative to the carrier means and each of the preforming devices being provided with a respective adjusting drive operable to effect adjustment of the or each adjustable roller of the roller pair of that device, and drive means mounted on the base plate and operable to simultaneously operate all the adjusting drives.

With this arrangement, it is possible in one operating step to simultaneously set all of the preforming devices from one location of the base plate.

In one preferred embodiment, the two preforming rollers of each device are arranged on a toothed member rotatable on a mounting plate of the carrier means, this member being reset through a worm and pinion of each device, and a gear rim disposed in engagement with the pinions of all of the devices. In that case, only the gear rim need be turned in order to effect the same variation of the roller setting in each preforming device.

According to another preferred embodiment, however, the axis of one roller of each device is stationary in the carrier means while the other roller is pivotable on a circular arc around the first mentioned roller. Levers carrying the pivotable rollers can each be provided with a toothed segment, and, as in the previouly mentioned embodiment, can be resettable centrally and simultaneously by means of a worm, a pinion, a toothed rack and a gear rim.

In yet another preferred embodiment, the resettable preforming roller of each device is guided in a straight slot in a mounting plate of the carrier means. The adjusting drive in this case comprises a spindle, which is screwed transversely through the roller axis, and the spindles of the adjusting drives can be simultaneously and centrally set by means of a pinion and a gear rim.

The slot can be parallel to the machine axis, but it can also be inclined thereto. In this case, the pinion and the gear rim must be constructed as bevel gears. It is also possible for both rollers of each drive to be movable and guided in slots, which can both be parallel or inclined to the machine axis, or also one can be parallel and the other inclined.

BRIEF DESCRIPTION OF THE DRAWINGS

The invention will be more readily comprehended from the following description when taken in conjunction with the appending drawings, wherein.

DESCRIPTION OF THE PREFERRED EMBODIMENTS

Figure 1:
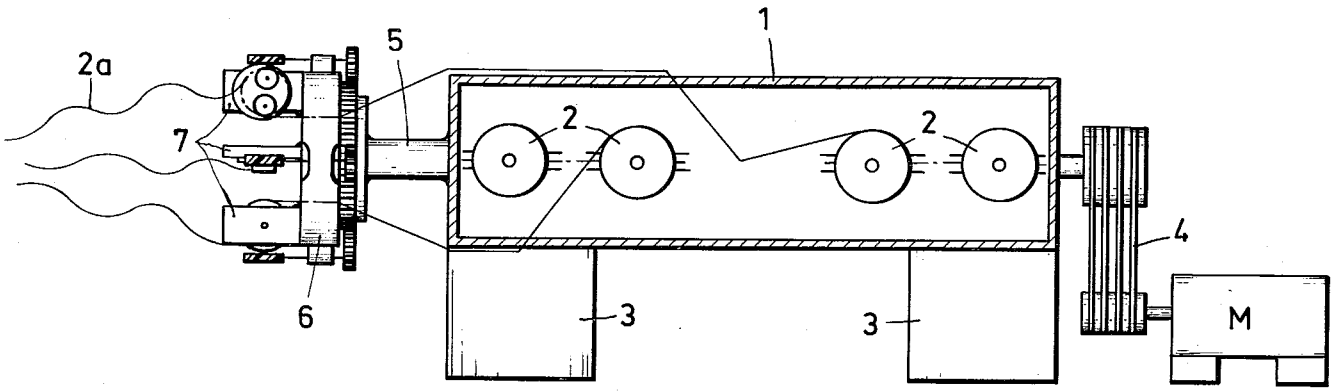
FIG. 1 is a schematic elevation of a stranding machine having attached thereto preforming apparatus according to a first embodiment of the invention.

Referring now to the drawings, there is shown in FIG. 1 a stranding machine comprising a cylinder 1 which contains wire spools 2. Although a rope is normally stranded out of six, eight or still more wires or strands, for the sake of simplicity only four spools are shown.

The cylinder 1 is rotatably mounted in known manner on bearing pedestals 3 and is driven through V-belts 4 by a motor M. A stranding pipe 5, which carries a base plate 6, is rigidly connected to an end face of the cylinder 1. The wires or strands 2*a* are guided in known manner through bores or slots uniformly distributed around the base plate near its circumference.

Mounted on the end face of the base plate remote from the cylinder 1 are a plurality of preforming devices 7, of which three are shown in FIG. 1. Each preforming device 7 consists of a mounting plate 8 (FIG. 2), which extends from the base plate at a right angle thereto. Mounted on the mounting plate to be rotatable about an axis 9 is a toothed member 10, on which in turn are rotatably mounted two preforming rollers 11.

A worm 12, which meshes with the toothing of the member 10, is provided as gear means for setting the rollers by rotation of the member 10. The worm 12 is rigidly mounted on a shaft 14, which is journalled in a bearing 6*a* on the circumference of the base plate 6. At its end remote from the worm 12, the shaft 13 carries a pinion 14, which engages in the gear rim 15 retained on the end face of the base plate 6 adjacent to the cylinder 1 by a retaining plate 6*b* to be rotatable concentrically with the base plate 6. Meshing with the gear rim 15 is a further small gear wheel 16 which is provided on its axis with a rectangular section bore into which a correspondingly shaped key 17 is insertable. The gear rim 15 and the small gear wheel 16 represent the drive means for the worm 12 and pinion 14 forming the gear means.

Guided between the preforming rollers 11 is the wire or strand 2*a*, which during the stranding is provided by the preforming device with a known helical shape. This helical shape is dependent in its dimensions on the setting of the preforming rollers. When a rope of a different diameter is to be stranded, the setting of the preforming rollers must be altered uniformly at all the preforming devices 7. Whereas it was hitherto necessary to set the rollers of each preforming device individually, in the apparatus shown in FIG. 2 this can now be undertaken centrally. For this purpose, the key 17 is inserted into the gear wheel 16 and the gear wheel is turned. Thereby, the gear rim 15 is turned so as to simultaneously rotate all the pinions 14 in engagement therewith and all the worms 12 connected to the pinions, whereby the same displacement is imparted to all the members 10. All the preforming rollers are thus reset in one operating step by turning of the key 17.

Instead of varying the setting of both preforming rollers for the adjustment, it is also possible for one roller to be stationary, with only the other roller being adjusted. Such arrangements are shown in FIGS. 3 and 4, the adjustable roller in the FIG. 3 arrangement being pivoted on a circular arc around the stationary roller, whereas the adjustable roller in the FIG. 4 arrangement is displaced along a straight path.

Figure 3:
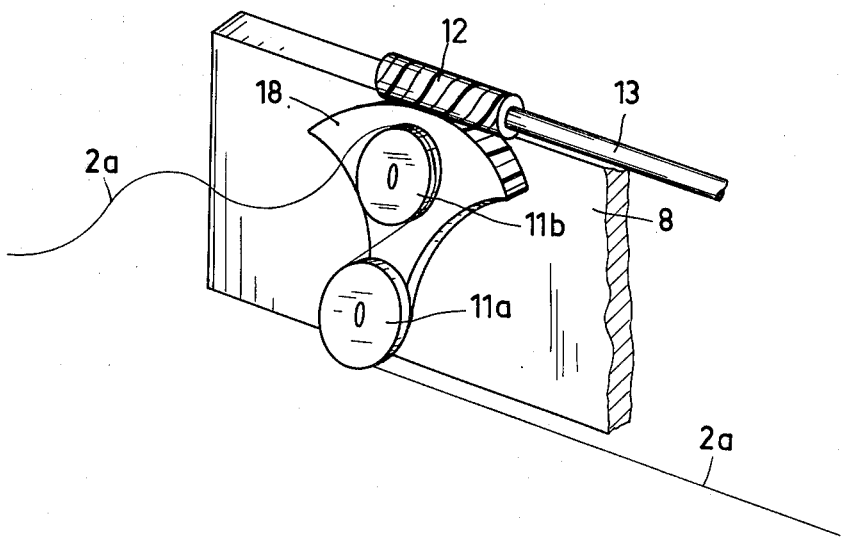
FIG. 3 is a schematic perspective view of part of a preforming apparatus according to a second embodiment of the invention.

In FIG. 3, a preforming roller 11*a* is mounted on the mounting plate 8 to be rotatable about an axis which is stationary in the plate. Mounted to be pivotable on the same axis is a toothed segment 18 which carries the other preforming roller 11*b*. Meshing with the toothing of the segment 18 is the worm 12. On pivotable movement thereof, the segment 18 displaces the roller 11*b* relative to the roller 11*a* to cause the looping angle of the wire 2*a* around the rollers to change. Accordingly, different helical shapes of the preformed wire are provided in dependence on the setting of the toothed segment 18. The central drive of the segments 18 of all preforming devices on a single base plate also takes place through worms 12, shafts 13, pinions 14, and gear rim 15 meshing with all the pinions.

Figure 4:
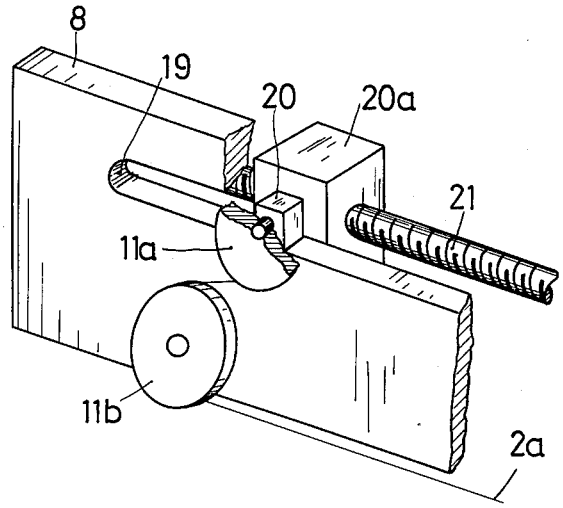
FIG. 4 is a schematic perspective view of part of a preforming apparatus according to a third embodiment of the invention.

In the embodiment according to FIG. 4, the preforming roller 11*a* is also mounted on the mounting plate 8 to be rotatable about an axis which is stationary in the plate. The plate is provided with a straight slot 19, along which the displaceable preforming roller 11*b* is guided. For this purpose, the roller 11*b* is rotatably mounted on a slide member 20 which is displaceable in the slot 19. On the side of the mounting plate 8 remote from the rollers, the slide member has a widened portion 20*a* provided with a threaded bore in which a spindle 21 is threadedly engaged at one end thereof. The spindle 21 is provided at its other end (not shown) with a pinion which meshes with the central gear rim. Turning of the gear rim in this embodiment accordingly leads to a simultaneous, rectilinear displacement of the movable rollers 11*b* of all the preforming devices.

Figure 5:
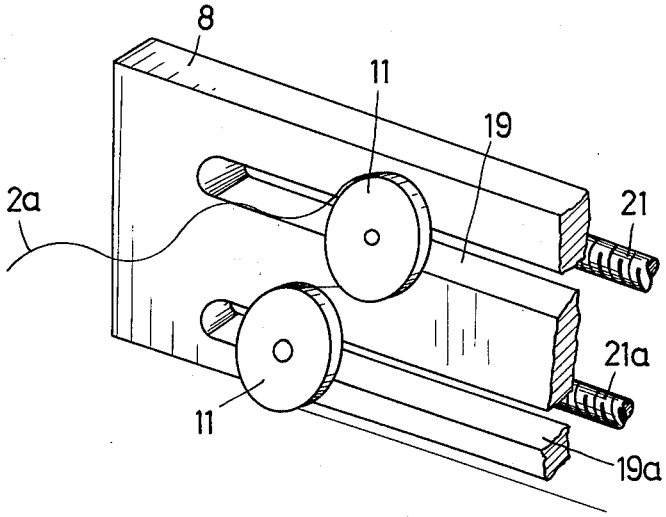
FIG. 5 is a schematic perspective view of part of a preforming apparatus according to a fourth embodiment of the invention.

In FIG. 5 there is shown an embodiment in which both preforming rollers 11 are movable. The rollers are respectively guided by two straight slots 19 and 19*a*, and are respectively driven by means of two spindles 21 and 21*a*. The gear rim (not shown) must, in this case, be constructed appropriately.

In the embodiments of FIGS. 4 and 5, the guide slots 19 and 19*a* have been illustrated as running parallel to the machine axis. It is, however, possible for the slots to run at an angle to the machine axis, even to have different inclinations. The pinions and the gear rim must be provided with a conical toothing, which is, however, within the scope of knowledge of the average machine constructor.

Figure 2:
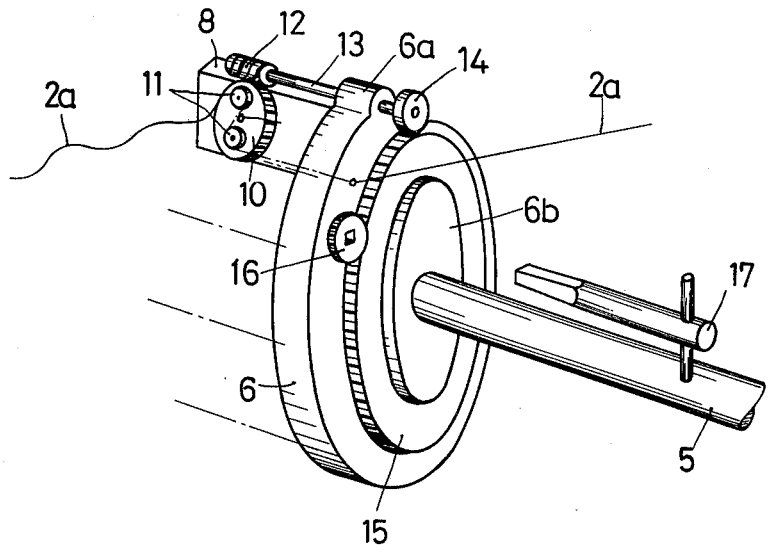
FIG. 2 is a schematic perspective view of the preforming apparatus of FIG. 1.
Figure 6:
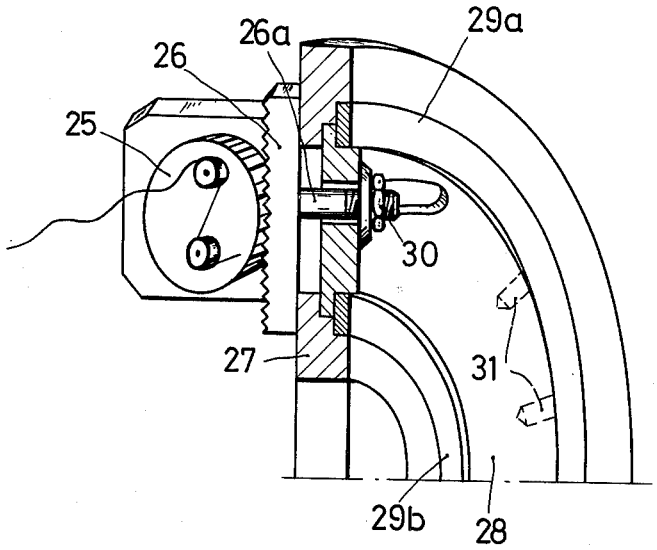
FIG. 6 is a schematic perspective view of part of a preforming apparatus according to a fifth embodiment of the invention.

Finally, in FIG. 6 there is shown an embodiment, in which a toothed member 25, which carries the preforming rollers and which corresponds to the member 10 of FIG. 2, is rotatable by means of a toothed rack 26 which is movable up and down. For this purpose, the toothed rack is provided with a bolt 26*a* which projects rearwardly through a radial slot in the base plate 27. Rotatably mounted at the rear side of the base plate is an annular member 28 which is retained by two rings 29*a* and 29*b*. The bolt 26*a* projects through a cam slot 28*a* in the member 28 and is provided behind the member 28 with a washer and nut 30. Although in FIG. 6 only one slot 28*a* is shown in the member 28, it is to be understood that the member possesses as many slots as there are preforming devices mounted at the base plate.

The cam slots have such an inclination that each bolt 26*a* and toothed rack 26 is displaced upwardly or downwardly on turning of the member 28. The member 25 carrying the two preforming rollers is thereby rotated, and the positions of the two preforming rollers are thus adjusted. This adjustment takes place simultaneously with all the preforming devices, so that a central, simultaneous adjustment of all the preforming devices is also provided in this embodiment.

To enable the member 25 to be turned, the member is provided on its circumference with radial bores 31 into which can be inserted an appropriately shaped tool for turning the member.

What is claimed is:

1. A preforming apparatus for preforming the wires in a stranding machine, the apparatus comprising:
   a. a base plate mountable on said stranding machine to be rotatable about the machine axis;
   b. carrier means mounted on said base plate;
   c. first and second rollers arranged on each carrier means to be rotatable about axes substantially perpendicular to and spaced from the machine axis, the axis of rotation of at least one of said rollers on each carrier means being adjustable in position relative to the other roller, said carrier means together with said preforming rollers defining individual preforming devices;
   d. adjusting drive means mounted on said carrier means for effecting adjustment of said adjustable rollers; and
   e. drive means mounted on said base plate and operable to simultaneously operate all said adjusting drive means.

2. Apparatus as claimed in claim 1, wherein the carrier means of each preforming device comprises a mounting plate arranged in a plane intersecting the machine axis.

3. Apparatus as claimed in claim 1, wherein the carrier means of each preforming device comprises a mounting plate, and the rollers of each roller pair are arranged in a respective plane containing the machine axis.

4. Apparatus as claimed in claim 1, wherein
   a. the rollers of each preforming device are mounted on a rotatable member provided with teeth;
   b. the adjusting drive of each device comprises a worm meshing with the teeth of said rotatable member;
   c. a pinion co-axial with the worm; and
   d. the drive means comprises a gear rim in driving engagement with all of the pinions of the adjusting drives.

5. Apparatus as claimed in claim 1, wherein two preforming rollers are mounted on each carrier means, and wherein the axis of rotation of only one roller of each roller pair is adjustable, said adjustable roller being mounted on a pivotable member, which is pivotable about the axis of rotation of the respective other roller and which is provided with arcuate teeth; the adjusting drive of each preforming device comprising a worm meshing with the teeth of the pivotable member of that device and a pinion co-axial with the worm, and the drive means comprising a gear rim in driving engagement with all of the pinions of the adjusting drives.

6. Apparatus as claimed in claim 1, wherein two preforming rollers are mounted on each carrier means, and wherein the axis of rotation of only one roller of each roller pair of each preforming device is adjustable, said one roller of each roller pair being mounted on slide means slidably engaged in a slot in the mounting plate of the respective carrier means, the other roller of each roller pair being journalled in the mounting plate to be rotatable about an axis having a stationary location in the mounting plate, the adjusting drive of each preforming device comprising a spindle, which is threadedly engaged in the slide means of said one roller of that device and which extends transversely to the axis of rotation of that roller, and a pinion co-axial with the spindle, and the drive means comprising a gear rim in driving engagement with all of the pinions of the adjusting drives.

7. Apparatus as claimed in claim 1, wherein two preforming rollers are mounted on each carrier means, and wherein the rollers of the roller pair of each preforming device are respectively mounted on two slide means respectively slidably engaged in two slots in the mounting plate of the carrier means of that device; the adjusting drive of each preforming device comprising two spindles, which are each threadedly engaged in a respective on of the slide means of the roller of that device and which each extend transversely to the axis of rotation of the roller mounted on such slide means, and two pinions respectively co-axial with the spindles, the drive means comprising two gear rims in respective driving engagement with the two pinions of each adjusting drive.

8. Apparatus as claimed in claim 6, wherein the slot extends parallel to the machine axis.

9. Apparatus as claimed in claim 6, wherein the slot extends at an angle relative to the machine axis and the pinion and gear rim are each constructed as bevel gears.

10. Apparatus as claimed in claim 7, wherein each of the slots extends parallel to the machine axis.

11. Apparatus as claimed in claim 7, wherein each of the slots extends at an angle relative to the machine axis, and the pinions and gear rim are each constructed as bevel gears.

12. Apparatus as claimed in claim 7, wherein the two slots in the mounting plate of the carrier means of each preforming device respectively extend parallel to the machine axis and at an angle to the machine axis.

13. Apparatus as claimed in claim 1, wherein two preforming rollers are mounted on each carrier means, and wherein the rollers of the roller pair of each preforming device are mounted on a rotatable member provided with teeth; the adjusting drive of each preforming device comprising a rack, which meshes with the teeth of the rotatable member of that device and which is provided with a pin extending in a direction away from the rotatable member; the drive means comprising an annular member, which is rotatably mounted on the base plate and which is provided with a plurality of cam surfaces each in driving engagement with a respective one of the pins of the adjusting drives.

* * * * *